US009581945B2

(12) United States Patent
Honda et al.

(10) Patent No.: US 9,581,945 B2
(45) Date of Patent: Feb. 28, 2017

(54) FIXING EXIT GUIDE PLATE, FIXING DEVICE, AND IMAGE FORMING APPARATUS

(71) Applicants: Haruyuki Honda, Kanagawa (JP); Ryuuichi Mimbu, Kanagawa (JP); Yoshio Hattori, Kanagawa (JP); Yoshiki Yamaguchi, Kanagawa (JP); Toshihiko Shimokawa, Kanagawa (JP)

(72) Inventors: Haruyuki Honda, Kanagawa (JP); Ryuuichi Mimbu, Kanagawa (JP); Yoshio Hattori, Kanagawa (JP); Yoshiki Yamaguchi, Kanagawa (JP); Toshihiko Shimokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/056,061

(22) Filed: Feb. 29, 2016

(65) Prior Publication Data

US 2016/0274508 A1 Sep. 22, 2016

(30) Foreign Application Priority Data

Mar. 19, 2015 (JP) ..... 2015-056533

(51) Int. Cl.
*G03G 15/20* (2006.01)

(52) U.S. Cl.
CPC ..... *G03G 15/2028* (2013.01)

(58) Field of Classification Search
CPC ..... G03G 15/2028; G03G 15/2035
USPC ..... 399/322, 323
See application file for complete search history.

(56) References Cited

U.S. PATENT DOCUMENTS

| | | | | |
|---|---|---|---|---|
| 7,920,819 | B2 * | 4/2011 | Miyake | G03G 15/2028 399/322 |
| 8,073,371 | B2 * | 12/2011 | Yamamoto | G03G 15/6576 399/323 |
| 8,280,288 | B2 * | 10/2012 | Aratachi | G03G 15/2028 399/323 |
| 8,699,929 | B2 * | 4/2014 | Sakaya et al. | G03G 15/2028 399/323 |
| 8,768,229 | B2 * | 7/2014 | Takahashi | G03G 15/2028 399/323 |
| 2012/0099875 | A1 | 4/2012 | Yagi et al. | |

FOREIGN PATENT DOCUMENTS

| | | |
|---|---|---|
| JP | 9-188456 | 7/1997 |
| JP | 2001-48399 | 2/2001 |
| JP | 2012-91891 | 5/2012 |

* cited by examiner

*Primary Examiner* — William J Royer
(74) *Attorney, Agent, or Firm* — Harness, Dickey & Pierce, PLC

(57) ABSTRACT

A fixing exit guide plate for use in a fixing device, which supports the conveyance of a paper while being curved in a direction opposite to a curl direction of the paper in a paper conveyance path downstream of conveyance support rollers, includes a conveyance downstream portion having a paper conveyance plane and a conveyance upstream portion having a paper conveyance plane, wherein the fixing exit guide plate is retracted in a paper jam process to move such that the paper conveyance plane of the conveyance downstream portion rotates about a rotation axis of the conveyance support driving roller to be substantially parallel to the paper conveyance plane of a conveyance upstream portion.

6 Claims, 7 Drawing Sheets

ONE-SIDED PAPER PASSAGE
(CURL CORRECTION)

ONE-SIDED PAPER PASSAGE
(HEAVY PAPER)

TWO-SIDED PAPER PASSAGE
(FIRST PLANE)

TWO-SIDED PAPER PASSAGE
(SECOND PLANE)

FIXING EXIT GUIDE PLATE, FIXING DEVICE, AND IMAGE FORMING APPARATUS

CROSS-REFERENCE TO RELATED APPLICATION

The present application is based on and claims priority to Japanese patent application No. 2015-056533, filed Mar. 19, 2015, the disclosure of which is hereby incorporated by reference herein in its entirety.

BACKGROUND

Technical Field

The present invention relates to a fixing exit guide plate for use in a fixing device, a fixing device, and an image forming apparatus using the same.

Description of Related Art

A fixing device includes a fixing member and a pressure member. Both of the members have contact with each other to form a fixing nip. A recording sheet on which a toner image is transferred is fed to the fixing member, and the toner image is thermally fixed on the recording sheet by heating while being pressed onto a periphery of the fixing member by the pressure member at the fixing nip.

The fixing member and the pressure member have a temperature difference. Due to such a temperature difference, the front and the back of the recording sheet (front on fixing member side and back on pressure member side) also have a temperature difference when the recording sheet passes through the fixing nip between the fixing member and the pressure member in the thermal fixing. More specifically, the temperature of the recording sheet, which has contact with the fixing member, is higher than that of the back of recording sheet, which has contact with the pressure member.

As a result, after the recording sheet passes through the fixing nip, much moisture contained in the recording sheet evaporates from the front of the recording sheet. The amount of moisture to be moved to the front of the recording sheet is increased. The amount of moisture is increased in the front of the recording sheet to be larger than that of the back of the recording sheet. As a result, the amount of extension is increased in the front of the recording sheet to be larger than that of the back of the recording sheet, causing curl of the recording sheet toward the back (hereinafter referred to as back curl).

A fixing device including a fixing member having a reduced heat capacity to increase a temperature increase speed has been recently developed in view of energy saving and a high warming up speed. Such a fixing device has a large temperature difference between the fixing member and the pressure member and also has a large temperature difference between the front and the back of the recording sheet in fixing since the recording sheet passes between the fixing member and the pressure member before the pressure member is warmed up. For this reason, large back curl of the recording sheet is generated in the fixing device. When the recording sheet having such large back curl is ejected, a predetermined number of the recording sheets cannot be stacked on a paper ejection tray, or the recording sheet cannot be appropriately stacked on the paper ejection tray.

To solve such a problem, a technique that corrects such curl of the recording sheet by pressing the recording sheet onto a guide plate has been proposed.

For example, in an image forming apparatus described in Patent Literature 1 (Japanese Laid-Open Patent No. 2001-48399), a first conveyance roller is disposed downstream of a fixing unit, and a second conveyance roller is disposed downstream of the first conveyance roller. A guide plate that curves a sheet in the direction opposite to the curl direction of the sheet is provided in a conveyance path from the first to second conveyance rollers. The conveyance speed of the sheet by the second conveyance roller is set to be faster than the conveyance speed of the sheet by the first conveyance roller. The sheet is thereby fed while being pressed onto the guide plate that curves the sheet in the direction opposite to the curl direction of the sheet, and thus, the curl of the sheet is corrected.

An image forming apparatus described in Patent Literature 2 (Japanese Laid-Open Patent No. H09-188456) includes a pair of rollers provided downstream of a fixing device, and a guide plate provided just after the rollers. The guide plate conveys a sheet ejected from the rollers while curving the sheet toward the opposite side, so that the curl of the sheet is corrected by curving the sheet in the direction opposite to the direction of the curl generated in the fixing device.

In a fixing device described in Patent Literature 3 (Japanese Laid-Open Patent No. 2012-91891, a guide plate is movably disposed between a fixing nip and an ejection nip to have contact with the back of a sheet, so as to curve the sheet in the direction opposite to direction of the curl generated in a fixing unit, and change a contact force by the strength of the sheet.

SUMMARY

However, when the methods of correcting curl described in Patent Literature 1 and Patent Literature 2 are used, the sheet is always forcibly curved in the direction opposite to the curl direction by the guide plate. For this reason, the following problems occur when passing a heavy paper.

(a) Since the back curl is not generated in the fixing device, the front curl is generated by the guide plate when the sheet always has contact with the guide plate.

(b) The back of the sheet is damaged by the guide plate and the guide plate is worn away due to a strong contact force between the guide plate and the sheet.

(c) It becomes difficult to stably convey the sheet when the leading end of the sheet is bent by the contact with the guide plate due to strong sheet rigidity.

The invention described in Patent Literature 3 aims to solve the above problems. In the invention described in Patent Literature 3, the guide plate that forcibly deforms the sheet can be moved in the retracted direction by the strength of the sheet, so that the guide plate is retracted when the contact pressure of the sheet and the guide plate increases.

However, in the invention described in Patent Literature 3, even though the guide plate is moved in the final retracted position, the guide plate is positioned by the strength of the sheet. For this reason, the sheet is fed while having contact with the guide plate. The back of the sheet that has contact with the guide plate has a first image, and the guide plate has contact with this first image. Although the toner of the first image of the back is not completely melted just after the fixing of a second image, the heated toner image has contact with the guide plate. In this case, uneven brightness (brightness difference between a portion having contact with the guide plate and a portion without having contact with the guide plate) is easily generated even by slight contact, and the uneven brightness cannot be completely prevented only by the adjustment of the contact pressure between the guide plate and the sheet only with the strength of the sheet. Moreover, since the relationship among the fixing nip, exit nip, and guide plate are limited, it becomes difficult to freely layout these.

Furthermore, the guide plates described in Patent Literatures 1 to 3 are configured to correct curl. However, the guide plates described in Patent Literatures 1 to 3 are configured with no consideration of a paper jam process performance in paper jam.

The present invention has been made in view of the above circumstances, and an object of the present invention is to provide a fixing exit guide plate that achieves both of a reduction in generation of curl and an improvement in a paper jam process, a fixing device, and an image forming apparatus.

To achieve the above object, an aspect of the present invention provides a fixing exit guide plate for use in a fixing device including a flexible endless fixing member, a nip forming member that has directly contact with the fixing member or has contact with the fixing member through a sliding sheet, a pressure member that faces the nip forming member through the fixing member and forms a nip by pressing, and a pair of conveyance support rollers having a conveyance support driving roller disposed on a back side of an image to support conveyance of a paper, which has passed through the nip, and a conveyance support driven roller disposed on a front side of the image to support the conveyance of the paper, which has passed through the nip, the fixing exit guide plate supporting the conveyance of the paper while being curved in a direction opposite to a curl direction of the paper in a paper conveyance path downstream of the conveyance support rollers, the fixing exit guide plate includes a conveyance downstream portion having a paper conveyance plane, and a conveyance upstream portion having a paper conveyance plane, wherein the fixing exit guide plate is retracted in a paper jam process to move such that the paper conveyance plane of the conveyance downstream portion rotates about a rotation axis of the conveyance support driving roller to be substantially parallel to the paper conveyance plane of the conveyance upstream portion.

DETAILED DESCRIPTION

Hereinafter, an entire configuration of an image forming apparatus according to the embodiment of the present invention will be described with reference to the drawings.

Figure 1:
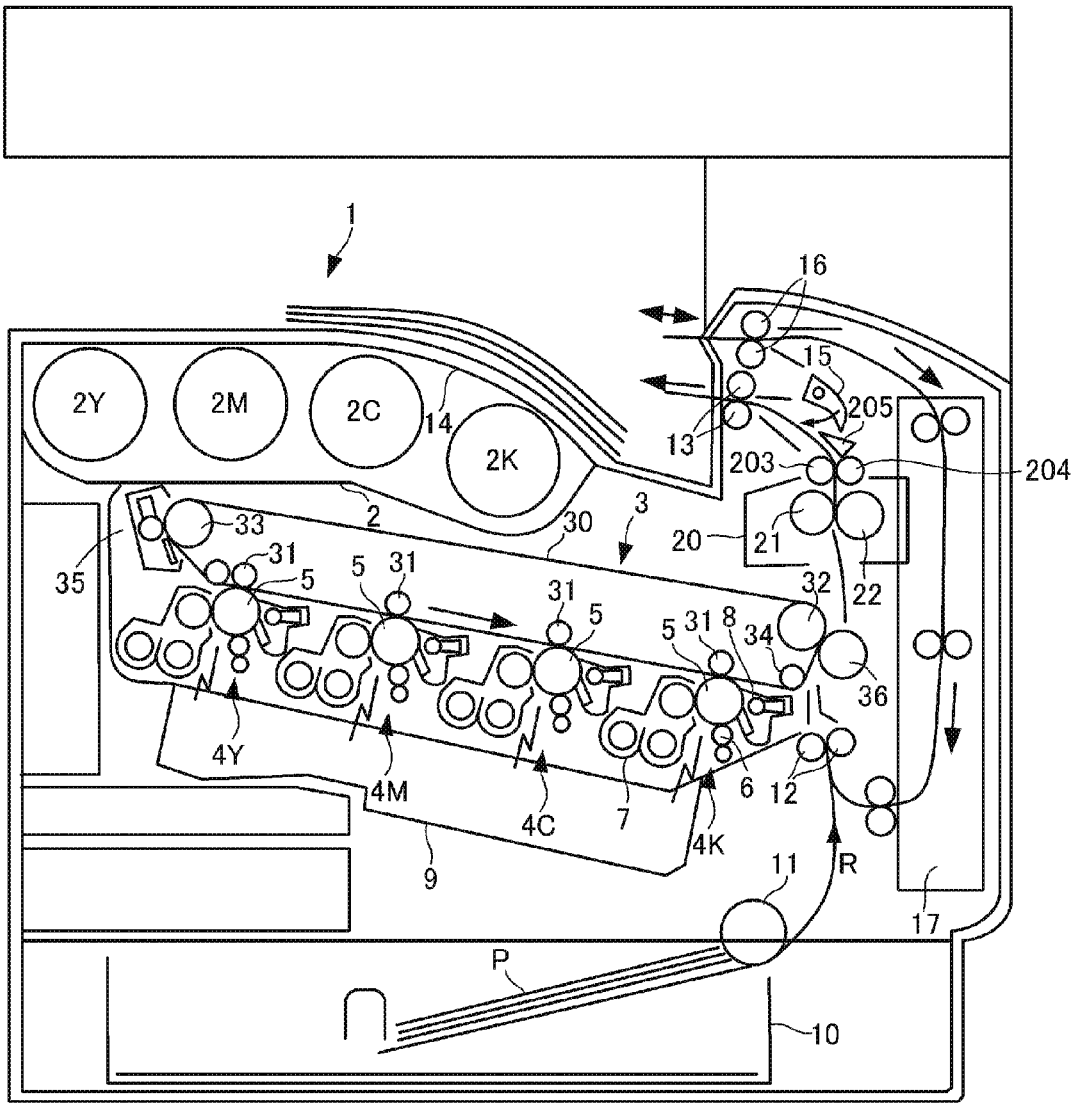
FIG. 1 is a schematic view showing an image forming apparatus according to an embodiment of the present invention.

An image forming apparatus 1 shown in FIG. 1 is a color laser printer. Four image forming units 4Y, 4M, 4C, and 4K are provided in the center of an image forming apparatus main body. The respective image forming units 4Y, 4M, 4C, and 4K basically have the same configuration. The respective image forming units 4Y, 4M, 4C, and 4K house developer of yellow (Y), magenta (M), cyan (C), and black (K), respectively, corresponding to color separation components of a color image.

Each of the image forming units 4Y, 4M, 4C, and 4K includes a drum-shaped photoconductor 5 as a latent image bearer, a charging device 6 that charges a surface of the photoconductor 5, a developing device 7 that supplies toner on the surface of the photoconductor 5, and a cleaner 8 that cleans the surface of the photoconductor 5. In FIG. 1, reference numbers are only applied to the photoconductor 5, the charging device 6, the developing device 7, and the cleaner 8 of the black image forming unit 4K. The reference numbers are omitted for the other image forming units 4Y, 4M, and 4C.

An exposing device 9 that exposes the surface of the photoconductor 5 is disposed below the image forming units 4Y, 4M, 4C, and 4K. The exposing device 9 includes a light source, a polygon mirror, an f-θ lens, and a reflection mirror, and irradiates the surface of each photoconductor 5 with a laser light based on image data.

A transfer device 3 is disposed above the image forming units 4Y, 4M, 4C, and 4K. The transfer device 3 includes an intermediate transfer belt 30 as an intermediate transfer body, four first transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt, and is stretched by the secondary transfer backup roller 32, the cleaning backup roller 33, and the tension roller 34. In this case, the intermediate transfer belt 30 rotates in the direction illustrated by the arrow in FIG. 1 by driving the secondary transfer backup roller 32.

The four first transfer rollers 31 and the photoconductors 5 sandwich the intermediate transfer belt 30 therebetween to form a primary transfer nip. A power source is connected to each of the four first transfer rollers 31 to apply a predetermined DC and/or AC voltage to each of the four first transfer rollers 31.

The secondary transfer roller 36 and the secondary transfer backup roller 32 sandwich the intermediate transfer belt 30 therebetween to form a secondary transfer nip. A power source is also connected to the secondary transfer roller 36 to apply a predetermined DC and/or AC voltage to the secondary transfer roller 36.

The belt cleaner 35 includes a cleaning brush and a cleaning blade disposed to have contact with the intermediate transfer belt 30. The waste toner collected by the belt cleaner 35 is housed in a waste toner container through a hose.

A bottle housing 2 is provided in the upper portion of the image forming apparatus main body. Four toner bottles 2Y, 2M, 2C, and 2K that house supplemental toner are detachably attached to the bottle housing 2. The toner is supplied to each of the developing devices 7 from each of the toner bottles 2Y, 2M, 2C, and 2K through a path provided between each of the toner bottles 2Y, 2M, 2C, and 2K and each of the developing devices 7.

A paper feeding tray 10 in which a paper P as a recoding medium is housed and a paper feeding roller 11 that conveys the paper P from the paper feeding tray 10 are provided in the lower portion of the image forming apparatus main body. The recording medium includes a heavy paper, a postcard, an envelope, a thin paper, a coating paper (art paper), a tracing paper, and an OHP sheet in addition to a regular paper. A manual paper feeding mechanism may be provided in the image forming apparatus main body.

A conveyance path R that ejects the paper P outside the device through the secondary transfer nip is provided inside the image forming apparatus main body. A pair of registration rollers 12 as a timing roller that conveys the paper P to the secondary transfer nip in conveyance timing is provided upstream of the secondary transfer roller 36 in the paper conveyance direction.

A fixing device 20 that fixes an unfixed image transferred onto the paper P is disposed downstream of the secondary transfer roller 36 in the paper conveyance direction. A pair of paper ejection rollers 13 that ejects the paper outside the image forming apparatus 1 is disposed downstream of the fixing device 20 in the paper conveyance direction of the conveyance path R. A paper ejection tray 14 that stocks the paper ejected outside the image forming apparatus 1 is provided on the top plane of the image forming apparatus main body.

Next, the basic operation of the image forming apparatus 1 according to the embodiment of the present invention will be described with reference to FIG. 1.

Upon the start of an image forming operation, each of the photoconductors 5 in each of the image forming units 4Y, 4M, 4C, and 4K rotate in the clockwise direction in FIG. 1, and the surface of each of the photoconductors 5 is uniformly charged by the charging device 6 to be a predetermined polarity. The charged surface of each photoconductor 5 is irradiated by the laser light from the exposing device 9, and the electrostatic latent image is formed on the surface of each photoconductor 5. The image information exposed on each photoconductor 5 is single color image information obtained by dissolving a desired full color image into color information of yellow, magenta, cyan, and black. The electrostatic latent image is visualized as a toner image by supplying the toner to the electrostatic latent image formed on each photoconductor 5 by each developing device 7.

Upon the start of the image forming operation, the secondary transfer backup roller 32 also rotates in the counterclockwise direction in FIG. 1 to rotate the intermediate transfer belt 30 in the direction shown by the arrow. A transfer electric field is formed at the primary transfer nip between each of the four first transfer rollers 31 and each of the photoconductors 5 by applying a constant voltage or a constant current controlled voltage having a polarity opposite to the polarity of the charged toner.

Thereafter, each color toner image on each photoconductor 5 is sequentially transferred onto the intermediate transfer belt 30 by a transfer electric field formed at the primary transfer nip when each color toner image on each photoconductor 5 reaches the primary transfer nip. The surface of the intermediate transfer belt 30 therefore carries the full color toner image. The residual toner on each photoconductor 5, which has not transferred to the intermediate transfer belt 30, is removed by the cleaner 8, and the surface of each photoconductor 5 is neutralized by a neutralizer to initialize the electric potential of the surface.

The paper feeding roller 11 rotates in the lower portion of the image forming apparatus 1, and the paper P is fed to the conveyance path R from the paper feeding tray 10. The paper P fed to the conveyance path R is once stopped by the registration rollers 12.

Thereafter, the registration rollers 12 start rotating at predetermined timing, and the paper P is fed to the secondary transfer nip when the toner image on the intermediate transfer belt 30 reaches the secondary transfer nip. The transfer voltage having a polarity opposite to the polarity of the charged toner of the toner image on the intermediate transfer belt 30 is applied to the secondary transfer roller 36. The transfer electric filed is thereby formed at the secondary transfer nip. The toner image on the intermediate transfer belt 30 is transferred onto the paper P by this transfer electric field. The residual toner on the intermediate transfer belt 30, which has not transferred onto the paper P, is removed by the belt cleaner 35, and is fed to the waste toner container.

Thereafter, the paper P is fed to the fixing device 20, and the toner image on the paper P is fixed on the paper P by the fixing device 20. The paper P fed from the fixing device 20 is guided in an ejection direction and re-conveyance direction through a separation member 15 that switches a path that ejects the paper P outside the image forming apparatus 1 and a two-sided reverse path.

In a one-sided paper passage mode, the separation member 15 is moved to open the path that ejects the paper P outside the image forming apparatus 1 by the pair of paper ejection rollers 13, and the paper P is ejected outside the image forming apparatus main body by the pair of paper ejection rollers 13 to be ejected on the paper ejection tray 14 on which the paper ejected outside the image forming apparatus main body is stacked.

In a two-sided paper passage mode, the separation member 15 is moved in the arrow direction to close the path, and the paper P having a fixed first image is guided to the two-sided reverse path. The paper P guided to the two-sided reverse path is switched back by the pair of reverse rollers 16, is fed to a two-sided unit 17, and is fed by a pair of registration rollers 12 again to be resupplied. A second image is printed on the back of the paper P similar to the first image. The paper P is ejected outside the image forming apparatus main body by the paper ejection rollers 13, and stacked on the paper ejection tray 14.

The above description is about the image forming operation for forming a full color image on the paper P. However, a single color image can be formed by using any one of four image forming units 4Y, 4M, 4C, and 4K or two or three colors image can be formed by using two or three image forming units.

A fixing exit guide plate and the fixing device according to the embodiment of the present invention will be described with reference to FIG. 2.

Figure 2:
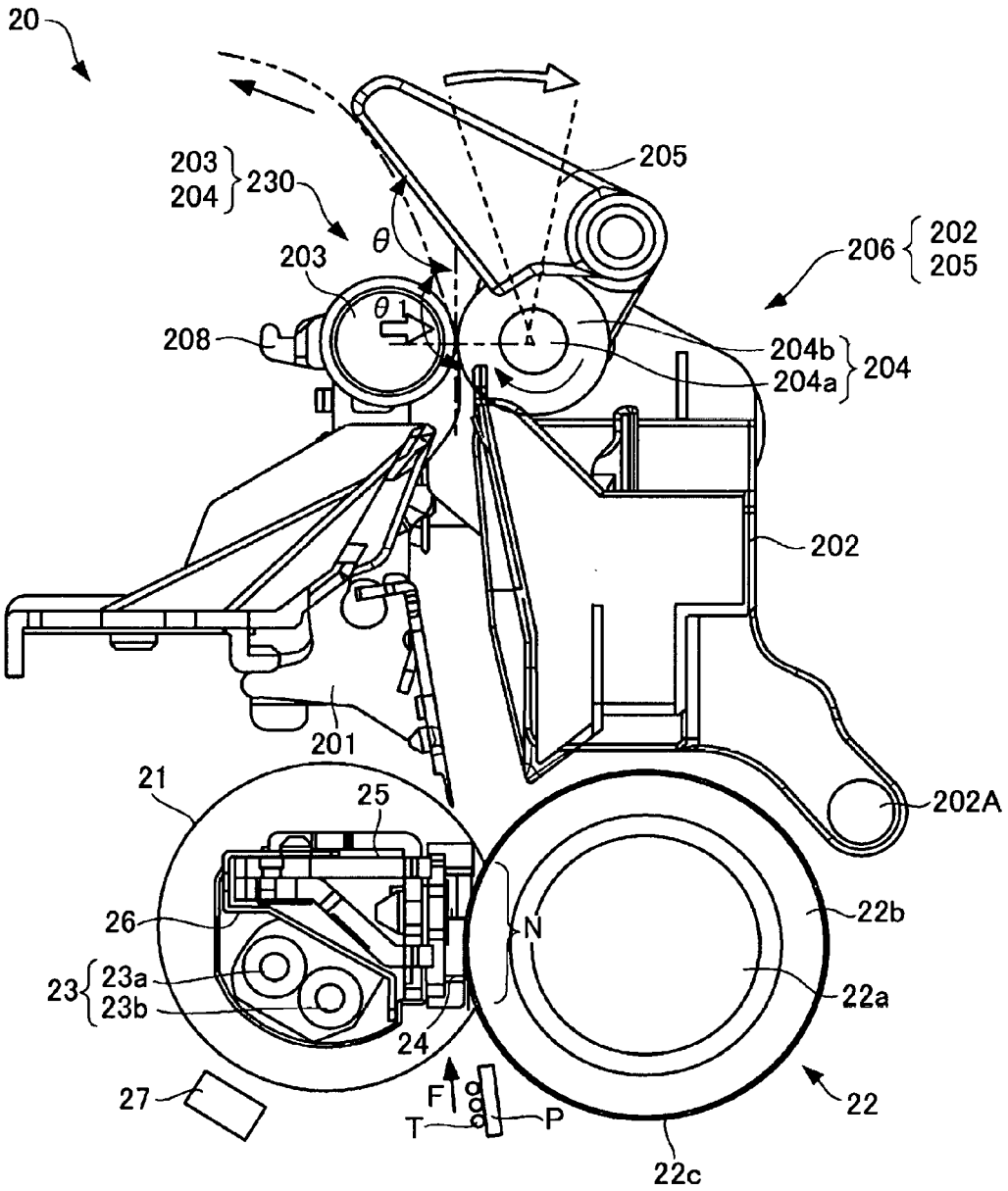
FIG. 2 is a sectional view showing a fixing exit guide plate and a fixing device according to the embodiment of the present invention.

FIG. 2 is a sectional view showing the fixing exit guide plate and the fixing device according to the embodiment of the present invention.

As shown in FIG. 2, the fixing device 20 is used to fix the toner image T after transferred onto the paper P by melting and permeating the toner image with heat and pressure. As shown in FIG. 2, the fixing device 20 includes a fixing belt 21 as a flexible endless fixing member which rotates while being heated.

The fixing device 20 also includes a pressure roller 22 (pressure member) as an opposing roller that forms a nip N by pressing the fixing belt 21 to apply a pressure between the fixing belt 21 and the pressure roller 22. The fixing belt 21 includes inside thereof a heater 23 having a plurality of halogen lamps 23*a* and 23*b* that heat the fixing belt 21 in a position other than the nip N.

The fixing belt 21 also includes inside thereof a nip forming member 24 as a base member for forming a nip, a stay 25 that supports the nip forming member 24, and a reflection member 26 that reflects the light from the heater 23 to the fixing belt 21. The nip forming member 24 includes a sliding sheet (low friction sheet) which wraps a base pad, and has contact with the fixing belt 21 through the sliding sheet.

The nip forming member 24 as shown in FIG. 2 forms the planer nip N. However, the shape of the nip N is not limited thereto. When forming a concave nip along the periphery of the pressure roller 22, the tip of the paper P passing through the nip N comes close to the pressure roller 22. The paper P is therefore effectively separated from the fixing belt 21.

The temperature of the fixing belt 21 is detected by a temperature sensor 27 provided on the entrance side of the paper P, and is used for a feedback control process of the heater 23. In FIG. 2, the arrow F shows the conveyance direction of the paper P.

The fixing belt 21 is a sleeve-like thin flexible endless belt, and includes a base material and a separation layer provided on the surface of the base material. The base material is made of a metal material such as nickel or ASUS or a resin material such as polyimide. The separation layer is made of tetrafluoroethylene-perfluoroalkylvinylether copolymer (PFA) or polytetrafluoroethylene (PTFE) having a separation performance to toner.

The pressure roller 22 includes a cored bar 22*a*, an elastic layer 22*b* which is provided on the surface of the cored bar 22*a* and is made of foamable silicone rubber, silicone rubber, or fluoro rubber, and a separation layer 22*c* which is provided on the surface of the elastic layer 22*b* and is made of PFA or PTFE. The pressure roller 22 is pressed to the fixing belt 21 to have contact therewith by a pressure device, and has contact with the nip forming member 24 as the base member.

When the pressure roller 22 has contact with the fixing belt 21, the elastic layer 22*b* of the pressure roller 22 is crushed, so that the nip N having a predetermined width is formed by the nip forming member 24 by receiving the pressure between the fixing belt 21 and the nip forming member 24.

The pressure roller 22 rotates by a driving source such as a motor provided in the image forming apparatus main body. Upon the rotation of the pressure roller 22, the driving force is transferred to the fixing belt 21 at the nip N to rotate the fixing belt 21.

In the fixing device 20 shown in FIG. 2, the pressure roller 22 is a solid roller, but may be a hollow roller. In this case, a heating source such as a halogen heater using radiation heat can be disposed inside the pressure roller 22. When the pressure roller 22 does not include the elastic layer 22*b*, the heat capacity of the pressure roller 22 is reduced, and a fixing performance is improved. However, the asperities of the surface of the belt may be transferred onto the image when fixing the unfixed toner, causing uneven brightness in a solid portion of the image.

To prevent such uneven brightness, it is desirable to provide an elastic layer having a thickness of 100 μm or more. For example, aluminum, iron, or stainless can be used for a pipe metal for use in a hollow roller. When providing a heat source inside the pressure roller 22, it is desirable to provide a heat insulation layer on a surface of a supporter or a hot wire reflection plane by a mirror plane process, so as to prevent the support from being heated by the radiation heat from the heat source. The heat source is not limited to the above-described halogen heater, and an IH heater, a resistance heat generator, or a carbon heater can be used.

The fixing device using the above-described hollow roller is configured to directly heat a heating member having a low heat capacity. Such a configuration rises a temperature at a high speed, and increases a printing speed. However, the toner is fixed before the pressure roller is sufficiently warmed up. For this reason, such a configuration significantly increases back curl due to the above-described temperature difference between the back and front of the paper.

A fixing exit guide plate 206 is provided in the fixing device 20 on the paper exit side. The fixing exit guide plate 206 separates the paper P passed through the nip N near the nip N, and guides the paper P to the ejection section in the ejection direction.

The fixing exit guide plate 206 includes a belt side separation and conveyance member 201 having a tip which is close to the fixing belt 21 downstream of the movement direction of the paper P moving from the nip N, a pressure side separation and conveyance member 202 as a conveyance upstream portion having a tip which is close to the pressure roller 22, and a fixing separator 205 as a conveyance downstream portion.

The belt side separation and conveyance member 201 is provided to separate the paper P, which may stick to the fixing belt 21, from the fixing belt 21. The belt side separation and conveyance member 201 is made of metal to be accurately positioned close to the surface of the fixing belt 21 to separate the paper P stuck to the surface of the fixing belt 21 from the fixing belt 21.

The pressure side separation and conveyance member 202 is made up of a resin molded product. The pressure side separation and conveyance member 202 includes a supporting rod 202A that is rotatably supported by a casing, so that a swinging end of the pressure side separation and conveyance member 202, which faces the pressure roller 22, is swingable to have contact and separate with and from the pressure roller 22.

The pressure side separation and conveyance member 202 swings relative to the pressure roller 22 in the direction away from the pressure roller 22 when removing the jammed paper P from the nip N. A space for inserting a hand into the nip N can be thus obtained. The paper P can be therefore drawn from the nip N.

A pair of conveyance support rollers 230 are disposed downstream of the separation and conveyance members, and includes a driving roller 204 as a conveyance support driving roller supported by the pressure side separation and conveyance member 202 and a driven roller 203 as a conveyance support driven roller supported by a holder 208. The driving roller 204 and the driven roller 203 support the conveyance of the paper P passed through the nip N. The driving roller 204 is disposed on the back side of the image which is the opposite side of the image by the toner image transferred on the paper P, and the driven roller 203 is disposed on the front side of the image.

The driving roller 204 includes a cored bar 204*a* and a solid rubber member 204*b* provided on the surface of the cored bar 204*a*. The solid rubber member 204*b* has a high friction coefficient, and is made of silicone, EPDM, urethane, or fluorine-contained rubber. The driving roller 204 obtains a paper conveyance force. The driven roller 203 includes a hollow pipe metal and a tube (for example, 30 to 300 μm of thickness) having a low μ (low friction coefficient. The tube is made of PFA, ETFA or FEP, for example. The tube covers the hollow pipe metal.

The reason for using the hollow pipe metal for the driven roller 203 is to lower the heat capacity to smoothly warm up the driven roller 203 by the heat of the fixing, so as to prevent the dew condensation that is adhered to the driven roller 203 by the moisture from the paper P in the fixing.

The reason for providing the tube having a low μ on the surface of the driven roller 203 is to avoid the adhesion of the residual toner which has not melted after the fixing, and to avoid the deposition of the toner even when such toner adheres to the tube. The driven roller 203 conveys the paper P while having contact with the front of the image.

The movable fixing separator 205 that guides the paper ejected from the pair of conveyance support rollers 230 is provided downstream of the conveyance support rollers 230 including the driving roller 204 and the driven roller 203.

Figure 3:
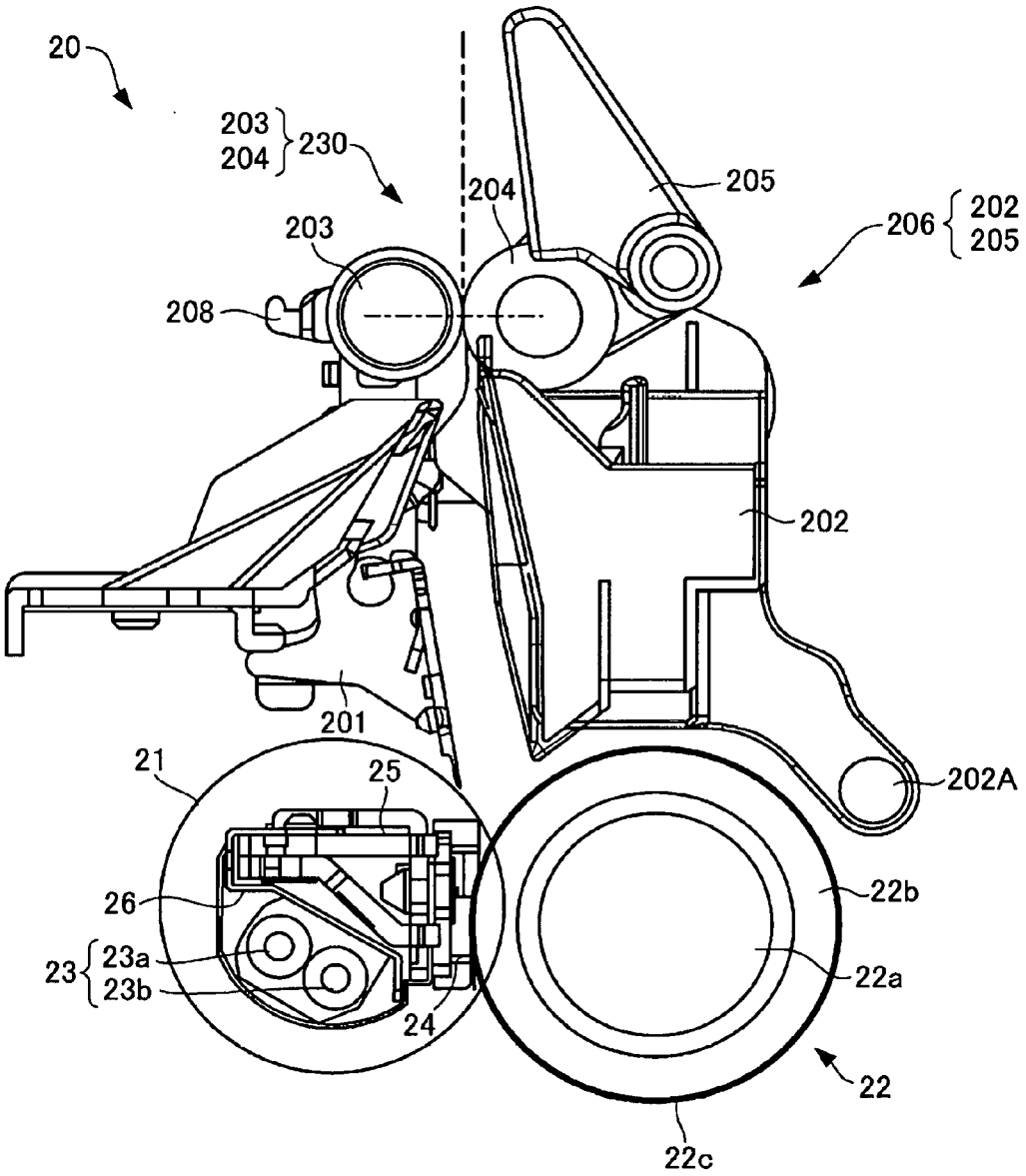
FIG. 3 is a sectional view showing a fixing exit guide plate and a fixing device according to the embodiment of the present invention.

The fixing separator 205 is movable in two steps of the position shown in FIG. 2 and the position shown in FIG. 3. The position of the fixing separator 205 shown in FIG. 2 changes the angle of the paper P ejected from the conveyance support rollers 230. This position is hereinafter referred to as a first position. The position of the fixing separator 205 shown in FIG. 3 does not change the angle of the paper P ejected from the conveyance support rollers 230. This position is hereinafter referred to as a second position.

When the fixing separator 205 is positioned as shown in FIG. 2, the fixing separator 205 blocks the path relative to the direction of the paper P ejected from the conveyance support rollers 230 (vertical direction to the line connecting the centers of the rollers). The tip of the paper P therefore has contact with the fixing separator 205 at an angle θ. The fixing separator 205 supports the conveyance of the paper P with the paper P being curved in the direction opposite to the curl direction of the paper P.

The paper P is fed by the conveyance force of the conveyance support rollers 230 while being pressed to the fixing separator 205. The paper P is finally curved in the direction opposite to the back curl direction by conveying the paper P at an angle θ1 from the nip portion of the conveyance support rollers 230 as an origination. The back curl of the paper P, which is generated in the fixing device 20, can be therefore improved, and the paper P ejected from the fixing separator 205 can be ejected.

However, the fixing separator 205 is configured to have contact with the back of the paper P. Such a configuration increases conveyance resistance and gives stress to the paper P. For this reason, when a heavy paper having a high strength is used as the paper P, a mark due to the contact with the fixing separator 205 may be generated on the back of the paper P, or the fixing separator 205 may be worn away. When passing the second plane of the paper in the two-sided paper passage mode, the fixing separator 205 has contact with the plane having an image (first plane of paper), and image scratches and gloss lines may be thereby generated. In the fixing of the second image, while the first image on the back of the paper passes through the nip N, the first image is again heated. Consequently, scratches may be generated and brightness is changed when the heated first image is rubbed.

On the other hand, when the fixing separator 205 is positioned as shown in FIG. 3, the fixing separator 205 is retracted from the paper in the direction of the paper P ejected from the conveyance support rollers 230 (vertical direction relative to the line connecting the centers of the conveyance support rollers 230). The fixing separator 205 therefore does not have contact with the paper P. Such a configuration gives no stress to the paper P, causing no back scratches, wear, rubbed images, and gloss lines.

More specifically, the fixing separator 205 and the separation member 15 are positioned as shown in FIGS. 7A to 7D corresponding to the respective paper passage modes. In the figures, the paper P is fed by the path shown by the dotted line in the figures.

Figure 7A:
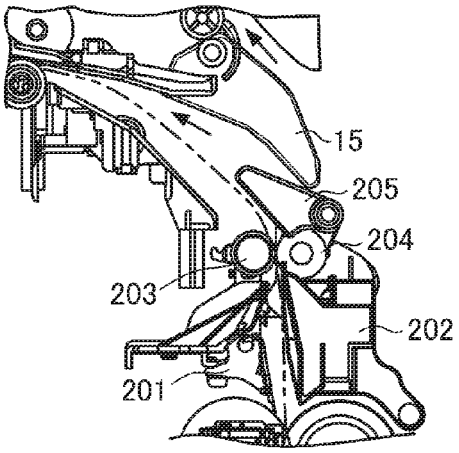
FIGS. 7A to 7D are views each showing the position of the fixing guide plate corresponding to each paper passage mode in the fixing device according to the embodiment of the present invention.
Figure 7B:
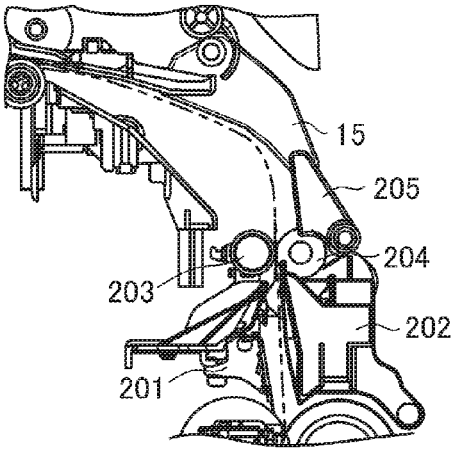

In the one-sided paper passage mode, when a paper having a thickness of 160 g/m2 or less is used, the fixing separator 205 and the separation member 15 are positioned as shown in FIG. 7A. In the one-sided paper passage mode, when a paper having a thickness of 160 g/m2 or more is used, the fixing separator 205 and the separation member 15 are positioned as shown in FIG. 7B.

Figure 7C:
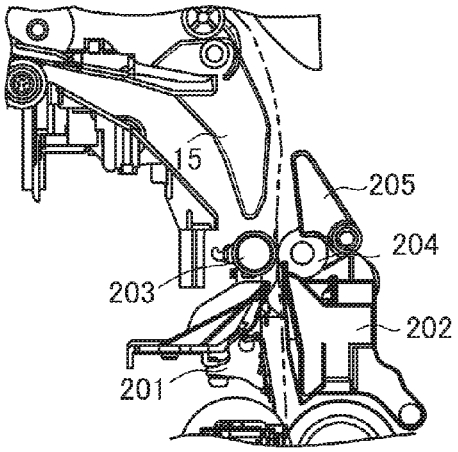
Figure 7D:
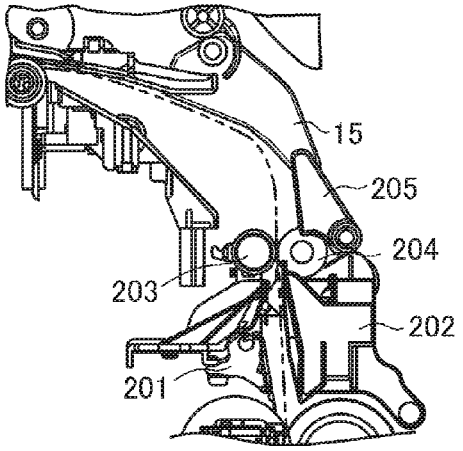

In the two-sided paper passage mode, when passing the first plane, the fixing separator 205 and the separation member 15 are positioned as shown in FIG. 7C. In the two-sided paper passage mode, when passing the second plane, the fixing separator 205 and the separation member 15 are positioned as shown in FIG. 7D.

Figure 4A:
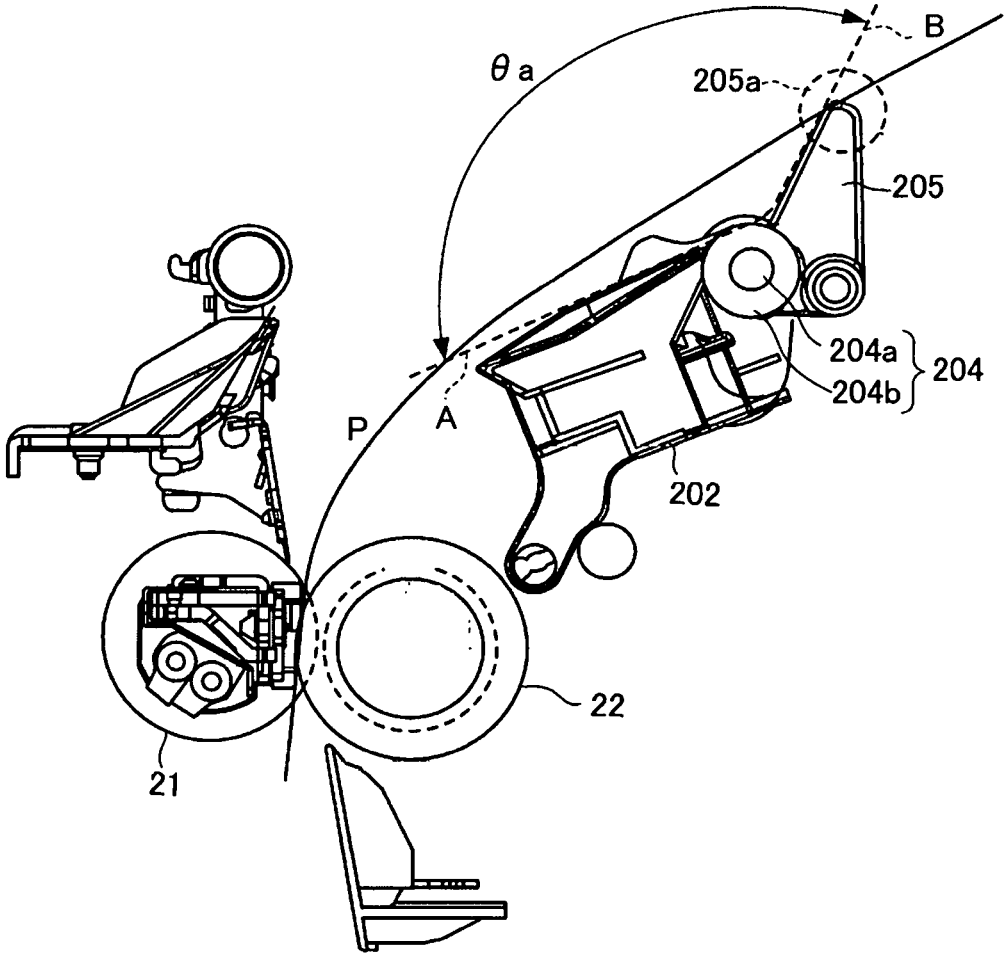
FIGS. 4A and 4B are views showing an opened fixing guide plate in the fixing device according to the embodiment of the present invention.
Figure 4B:
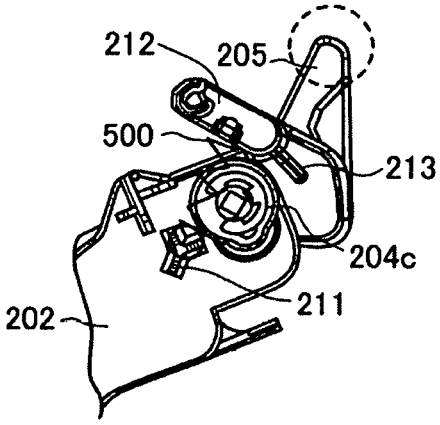

FIGS. 2 and 3 show the general printing in the image forming apparatus 1. FIGS. 4A and 4B show that the pressure side separation and conveyance member 202 rotates about the supporting rod 202A when removing the jammed paper P from the nip N. The fixing separator 205 is rotatably supported on a bearing 204*c* supported by the cored bar 204*a* of the driving roller 204.

An angle θa between a tangential line A relative to the paper conveyance plane of the pressure side separation and conveyance member 202 and a tangential line B relative to the paper conveyance plane of the fixing separator 205 is an angle slightly smaller than 180° (flat), as shown in FIG. 4A. For this reason, a tip 205*a* of the fixing separator 205 may disturb the paper jam process by an operator, or the paper P may be broken by the tip 205*a* of the fixing separator 205 when the jammed paper P between the fixing belt 21 and the pressure roller 22 is pulled. Thus, the paper P may stay in the nip N between the fixing belt 21 and the pressure roller 22.

FIG. 4B is a view showing the details of the circumference of the fixing separator 205. A downstream hook 212 integrated with the fixing separator 205 is biased by a biasing member 500 such that the fixing separator 205 is maintained as shown in FIG. 4B. The biasing member 500 includes an elastic body such as a spring. An upstream hook 211 is an origination with which the biasing member 500 is engaged. A reinforcement rib 213 supports the downstream hook 212 to reinforce the downstream hook 212.

Figure 5A:
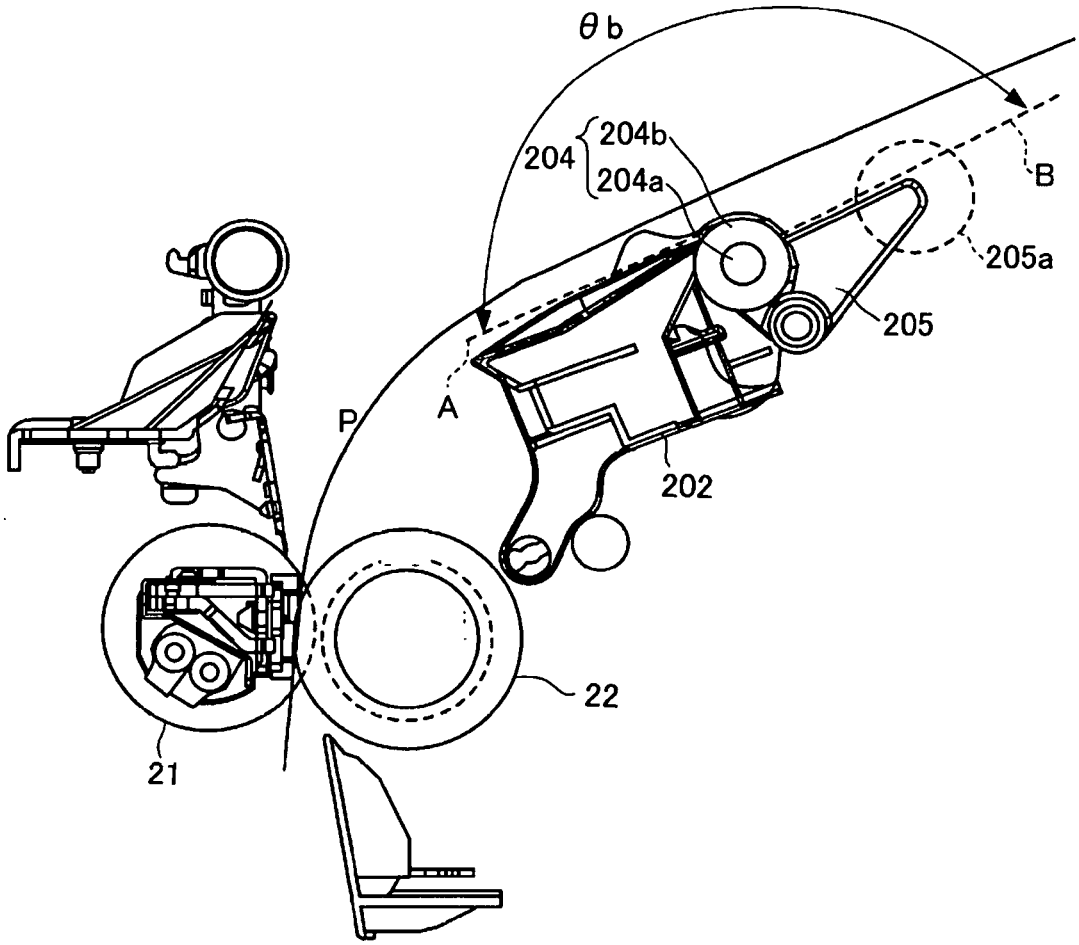
FIGS. 5A and 5B are views showing the opened fixing guide plate in the fixing device according to the embodiment of the present invention.

Similar to FIGS. 4A and 4B, FIGS. 5A and 5B show that the pressure side separation and conveyance member 202 rotates about the supporting rod 202A to be retracted when removing the jammed paper P from the nip N. Different from FIG. 4A, FIG. 5A shows that the fixing separator 205 rotates at approximately 180° (flat) when the angle between the tangential line A relative to the paper conveyance plane of the pressure side separation and conveyance member 202 and the tangential line B relative to the paper conveyance plane of the fixing separator 205 is θb.

The angle θb is larger than the angle θa shown in FIG. 4A. Namely, θb>θa is established. In addition, it is preferable for the fixing separator 205 to rotate at θb>160° which is an angle close to the flat.

Figure 5B:
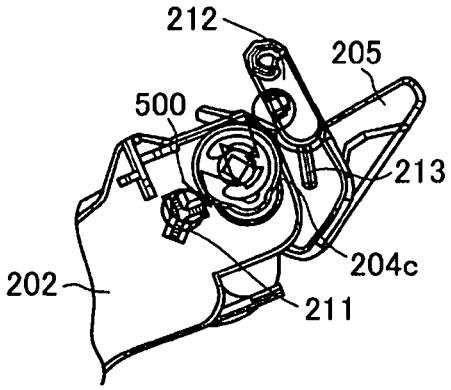

An operator pulls the jammed paper with a pulling force larger than the biasing force by the biasing member 500, and the fixing separator 205 is pushed back by the jammed paper, so that the fixing separator 205 further rotates as shown in FIG. 5B from the position shown in FIG. 4B.

As described above, the fixing exit guide plate 206 according to the embodiment is configured to support the conveyance of the paper P while being curved in the direction opposite to the curl direction of the paper P in the paper conveyance path downstream of the conveyance support rollers 230. The fixing exit guide plate 206 is retracted in the paper jam process such that the paper conveyance plane of the fixing separator 205 rotates about the rotation axis of the driving roller 204 to be substantially parallel to the paper conveyance plane of the pressure side separation and conveyance member 202.

Consequently, the fixing exit guide plate 206 curves the paper P in the direction opposite to the curl direction. The generation of the curl can be thus lowered. The fixing separator 205 rotates in the retracted position of the fixing separator 205 of the fixing exit guide plate 206 in the paper jam process. Such a configuration prevents the tip 205*a* of the fixing separator 205 from disturbing the paper jam process by an operator and from being damaged by the pulling of the jammed paper sandwiched between the fixing belt 21 and the pressure roller 22. Such a configuration also prevents the paper P from being remained in the nip N between the fixing belt 21 and the pressure roller 22. The fixing exit guide plate 206 therefore improves the paper jam process performance.

Moreover, $\theta a<\theta b$ and $\theta b>160°$ may be established where $\theta a$ is an angle, that is before the fixing separator 205 moves, between the tangential line of the paper conveyance direction relative to the paper conveyance plane of the pressure side separation and conveyance member 202 and the tangential line of the paper conveyance direction relative to the paper conveyance plane of the fixing separator 205 and $\theta b$ is an angle, that is after the fixing separator 205 moves, between the tangential line of the paper conveyance direction relative to the paper conveyance plane of the pressure side separation and conveyance member 202 and the tangential line of the paper conveyance direction relative to the paper conveyance plane of the fixing separator 205.

With this configuration, the pressure side separation and conveyance member 202 and the fixing separator 205 of the fixing exit guide plate 206 rotate to be flat in the paper jam process. Such a configuration prevents the paper jam process by an operator from being disturbed and the paper P from being damaged. The paper jam process performance is therefore improved.

The fixing separator 205 may be biased by the biasing member 500 such that $\theta a$ has an angle slightly smaller than 180° (flat) as shown in FIG. 4A in the regular printing (except heavy paper passage and two-sided paper passage). The resisting force of the paper P relative to the fixing separator 205 prevents the fixing separator 205 from being retracted. The shape of the fixing exit guide plate 206 in the passage of the paper conveyance path can be maintained, and a preferable paper conveyance performance can be obtained. The retracted state herein is achieved when the fixing separator 205 rotates to increase $\theta a$ shown in FIG. 4A. Namely, an operation with no relation to the reduction of the curl is not performed in the regular printing.

Figure 6:
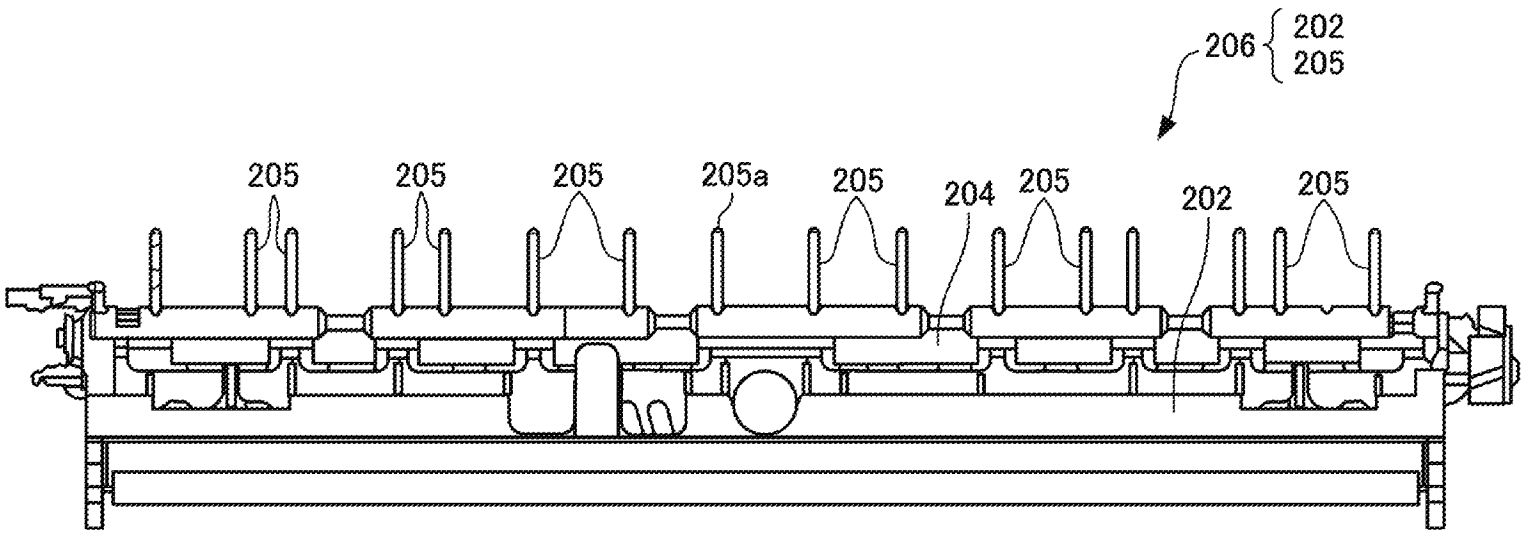
FIG. 6 is a front view showing the fixing exit guide plate and the fixing device according to the embodiment of the present invention.

The fixing separator 205 may have a comb shape as shown in FIG. 6. Such a configuration allows an operator to check the jammed paper P from the spaces between the tips 205*a* of the comb-shaped fixing separators 205 when the operator opens an external cover in the paper jam process (before the pressure side separation and conveyance member 202 is positioned as shown in FIGS. 2 and 3). The visibility of the jammed paper P is improved, and the jammed paper P is completely removed.

As described above, since the fixing separator 205 rotates to be retracted as shown in FIGS. 4A and 5B, the comb-shaped fixing separators 205 having the tips 205*a*, which have a high risk of damaging, can be achieved.

According to the embodiment of the present invention, both of the reduction in the generation of the curl and the improvement in the paper jam process performance can be achieved by curving the conveyance path near the fixing exit. Such a configuration is effective for the fixing exit guide plate, the fixing device, and the image forming apparatus.

Although the present invention has been described in terms of an exemplary embodiment, it is not limited thereto. It should be appreciated that variations or modifications may be made in the embodiment described by persons skilled in the art without departing from the scope of the present invention as defined by the following claims.

What is claimed is:

1. A fixing exit guide plate for use in a fixing device, the fixing device including a flexible endless fixing member, a nip forming member that contacts the fixing member directly or through a sliding sheet, a pressure member that faces the nip forming member through the fixing member and forms a nip by pressing, and a pair of conveyance support rollers, the pair of conveyance support rollers including a conveyance support driving roller on a back side of an image to support conveyance of a paper which has passed through the nip, and a conveyance support driven roller on a front side of the image to support the conveyance of the paper which has passed through the nip, the fixing exit guide plate configured to support the conveyance of the paper while being curved in a direction opposite to a curl direction of the paper in a paper conveyance path downstream of the pair of conveyance support rollers, the fixing exit guide plate comprising:

a conveyance downstream portion having a paper conveyance plane; and a conveyance upstream portion having a paper conveyance plane, wherein the fixing exit guide plate is configured to be retracted in a paper jam process to move such that the paper conveyance plane of the conveyance downstream portion rotates about a rotation axis of the conveyance support driving roller to be substantially parallel to the paper conveyance plane of the conveyance upstream portion.

2. The fixing exit guide plate according to claim 1, wherein, $\theta a$ is an angle between a tangential line of the paper conveyance direction relative to the paper conveyance plane of the conveyance upstream portion and a tangential line of the paper conveyance direction relative to the paper conveyance plane of the conveyance downstream portion, prior to a movement of the conveyance downstream portion; and $\theta b$ is an angle between the tangential line of the paper conveyance direction relative to the paper conveyance plane of the conveyance upstream portion and the tangential line of the paper conveyance direction relative to the paper conveyance plane of the conveyance downstream portion, subsequent to the movement of the conveyance downstream portion;

$\theta a<\theta b$; and $\theta b>160°$.

3. The fixing exit guide plate according to claim 1, wherein, the conveyance downstream portion of the fixing exit guide plate is biased by a biasing force, retraction of the fixing exit guide plate according to the biasing force is at least partially mitigated by a resisting force of paper fed by the conveyance support rollers, relative to the fixing exit guide plate.

4. The fixing exit guide plate according to claim 1, wherein the conveyance downstream portion has a comb shape.

5. A fixing device comprising the fixing exit guide plate according to claim 1.

6. An image forming apparatus comprising the fixing device according to claim 5.

* * * * *